US006176114B1

(12) United States Patent
Gmurowski

(10) Patent No.: US 6,176,114 B1
(45) Date of Patent: Jan. 23, 2001

(54) METHOD AND APPARATUS FOR SEQUENTIAL AXIAL FEED HYDROFORMING

(75) Inventor: Romuald Gmurowski, Rochester Hills, MI (US)

(73) Assignee: General Motors Corporation, Detroit, MI (US)

( * ) Notice: Under 35 U.S.C. 154(b), the term of this patent shall be extended for 0 days.

(21) Appl. No.: 09/576,496

(22) Filed: May 23, 2000

(51) Int. Cl.[7] ..... B21D 15/06; B21D 26/02
(52) U.S. Cl. ..... 72/59; 72/62; 29/421.1
(58) Field of Search ..... 72/59, 61, 62; 29/421.1

(56) References Cited

U.S. PATENT DOCUMENTS

| | | | | |
|---|---|---|---|---|
| 2,222,762 | * | 11/1940 | Debor et al. | 72/61 |
| 3,130,771 | | 4/1964 | Peyton | 153/73 |
| 4,052,872 | | 10/1977 | Herr | 72/62 |
| 4,237,713 | | 12/1980 | Benteler et al. | 72/59 |
| 4,319,471 | * | 3/1982 | Benteler et al. | 72/59 |
| 4,660,269 | | 4/1987 | Suzuki | 29/523 |
| 4,763,503 | | 8/1988 | Hughes et al. | 72/57 |
| 4,788,843 | * | 12/1988 | Seaman et al. | 72/58 |
| 4,840,053 | | 6/1989 | Nakamura | 72/58 |
| 4,928,509 | | 5/1990 | Nakamura | 72/61 |
| 4,996,857 | * | 3/1991 | Kageyama et al. | 72/10 |
| 5,056,346 | | 10/1991 | Ohtaka | 72/59 |
| 5,214,948 | | 6/1993 | Sanders et al. | 72/58 |
| 5,481,892 | * | 1/1996 | Roper et al. | 72/61 |
| 5,918,494 | | 7/1999 | Kojima et al. | 72/58 |
| 5,941,112 | | 8/1999 | Ghiran et al. | 72/55 |
| 6,044,678 | * | 4/2000 | Olszewski | 72/59 |

* cited by examiner

*Primary Examiner*—David Jones
(74) *Attorney, Agent, or Firm*—Charles E. Leahy

(57) ABSTRACT

A tube member is placed in a die having a plurality of nodules formed in the cavity thereof. A chamber is formed between a mandrel and end piece within the tube. The mandrel is positioned adjacent a first of the nodules and the chamber is pressurized during a hydroforming cycle to form a node on the tube by simultaneously expanding a portion of the tube outward and feeding the tube linearly into the die cavity. A mechanism for feeding the tube linearly is external to the die cavity and has a member in abutment with one end of the tube. During a positioning cycle, the pressure in the chamber is reduced and the mandrel is moved longitudinally within the tube to a position adjacent the next sequential nodule to permit a repeat of the hydroforming cycle. In one embodiment of the hydroforming process, a mandrel is positioned into the tube from each tube end and a feed mechanism is disposed adjacent each tube end. This permits the sequential simultaneous hydroforming of pairs of nodes on the tube.

7 Claims, 4 Drawing Sheets

METHOD AND APPARATUS FOR SEQUENTIAL AXIAL FEED HYDROFORMING

TECHNICAL FIELD

This invention relates to hydroforming and more particularly to sequential hydroforming a series of expansions in a tubular component.

BACKGROUND OF THE INVENTION

With the current method and apparatus a tube member is inserted into a die and the ends of the tube are engaged by sealing units. Fluid is introduced into the tube through the sealing units and pressurized to enforce stretching of the tube diameter to fill the die cavity which has the desired final shape of the expansion. Frequently in addition to and simultaneously with the pressurized fluid, an axial force is applied to one or both tube ends to assist in feeding material to the areas of expansion. This will reduce the tendency of the tube wall thickness to decrease as the diameter expands.

The currently employed technique has some serious disadvantages. The process is limited to expanding material into two adjacent cavities in the die when axial assist is employed. If the die has additional cavities, the material will be forced into the end cavities if conventional axial feed techniques are employed. The high pressure within the tube creates a large normal force between the tube and the die which results in large frictional forces when the tube diameter expands to abut the die surface. This is particularly true when the tube is attempting to expand into the center expansion cavities of the die. Another disadvantage is that the die must have at least the same length as the die. A further disadvantage is found in components having the expansion nodules formed at a distance from one end of the tube. This is related to the frictional forces that are created between the die and the tube as the fluid pressure therein is increased.

SUMMARY OF THE INVENTION

It is an object of the present invention to provide an improved method and apparatus for sequentially hydroforming a series of expanded areas on a tubular member.

In one aspect of the present invention, the expanded areas are formed singularly in sequential progression in a die cavity. In another aspect of the present invention, the tube material is fed into the die cavity from only one end. In yet another aspect of the present invention, the tube is fed axially into the die cavity independently of the pressure supply mechanism. In still another aspect of the present invention, the pressure supply mechanism comprises a seal component that sealingly engages the inner surface of the die. In still another aspect of the present invention, the tube is fed by a mechanism from a position external to the die cavity.

In yet still another aspect of the present invention, an axially moveable mandrel is disposed in the interior of the tube. In a further aspect of the present invention, the an axial feed mechanism is provided to move the mandrel and the tube in one axial direction during hydroforming and the mandrel in the opposite axial direction between forming steps. In a yet further aspect of the present invention, an axial movement mechanism is provided to move a portion of the pressure supply mechanism axially during the forming of an expansion area. In a still further aspect of the present invention, a pusher mechanism is provided to move the tube axially relative to the die during the hydroforming process. In a yet still further aspect of the present invention, a tube feed mechanism is provided at both ends of the tube and oppositely moveable mandrels are disposed for axial movement along the interior of the tube to position; and an interior pressure is supplied to sequentially form pairs of expanded areas.

Four embodiments of the invention are shown and described in the following description and drawings. In each of the embodiments, a die is provided with a plurality of recesses formed therein. A tubular member is positioned in a central longitudinal opening of the die and the die is closed. A sealing mandrel is disposed in the tube with one end thereof near the recess to be formed. Pressure is admitted to the interior of the tube to cause expansion thereof into the recess and the tube is simultaneously fed into the die by a pusher mechanism. The tube feed prevents the thinning of tube wall during expansion.

In one of the embodiments the tube feed is independent of the mandrel position control. In another embodiment the tube feed and mandrel move simultaneously during expansion of the tube and the mandrel is positioned independently of the tube feed between expansion operations. In yet another embodiment the tube feed mechanism operates on one end of the tube and the mandrel is positioned from the other end of the tube. With this embodiment the tube positioned at the mandrel end of the die and the die is moved relative to the mandrel to effectively cause the tube feed movement. In a further embodiment a tube feed mechanism and mandrel positioning control are disposed at both ends of the tube to permit the simultaneous expansion of two locations on the tube.

DESCRIPTION OF EXEMPLARLY EMBODIMENTS

Figure 1:
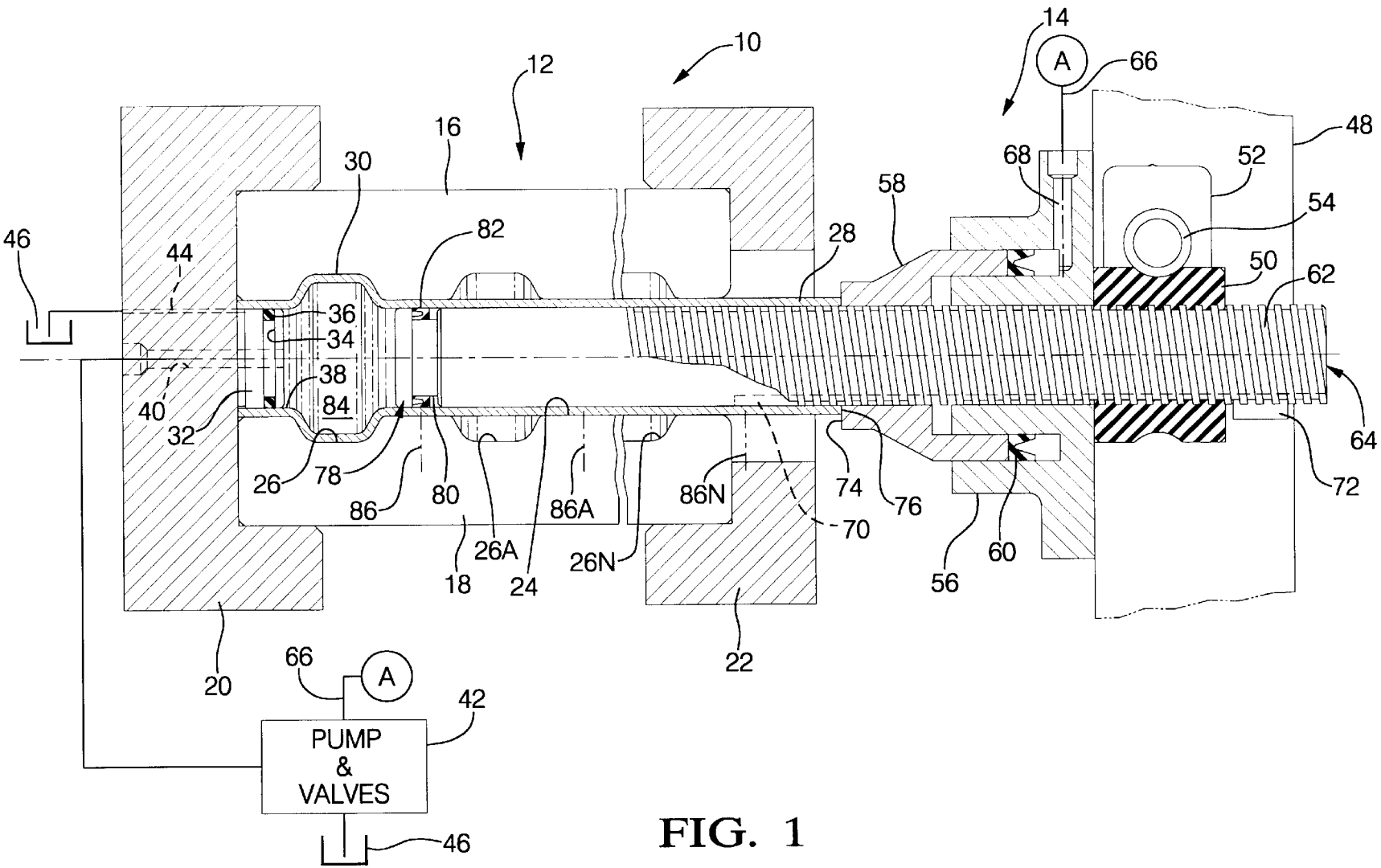
FIG. 1 is a sectional elevational view of a portion of a tube expansion mechanism incorporating one embodiment of the present invention.

Referring to the drawings wherein like characters represent the same or corresponding parts throughout the several embodiments, a hydroforming mechanism 10, FIG. 1, includes a die assembly 12, and feed assembly 14. The die assembly 12 has an upper die block 16 and a lower die block 18 that are forced together by a conventional press machine, not shown. A pair of end caps 20 and 22 are positioned to prevent separation of the die blocks 16, 18 during the expansion operation. The die blocks 16 and 18 form a cavity 24 in which is formed a plurality of recesses or nodules 26.

The number of nodules is determined by the maximum number of expansion nodes that are to be formed on a tube 28 that is positioned in the die cavity 24. One expansion node 30 is formed in the nodule 26. Prior to forming the node 30 the tube 28 has a substantially constant cross section. The end cap 20 has a protuberance or projection 32 which includes a groove 34 in which a seal 36 is positioned. The seal 36 engages the inner surface 38 of the tube 28 and cooperates therewith to form a fluid tight seal. A passage 40 is formed through the end cap 20 and the projection 32. The passage is connected with a high pressure supply source such as a pump and control valving 42. The pump and control valving 42 supply high pressure hydraulic fluid to and exhaust fluid from the end cap 20 on demand. A second passage 44, formed in the end cap 20 returns any hydraulic fluid that leaks past the seal 36 to a reservoir 46.

The feed mechanism 14 has a support housing 48 in which is disposed a drive nut 50 that is powered by a conventional servo or stepper motor 52 and worm gear 54. The housing 48 also supports a hydraulic cylinder 56 in which is slidably disposed a piston or pusher member 58 and a seal 60. The drive nut engages a thread 62 that is formed on a mandrel 64. The cylinder 56 is connected with the pump and control valving 42 or other suitable source of pressurized fluid through a passage 66. A passage 68 formed in the cylinder 56 supplies hydraulic fluid to the seal 60 to urge the piston 58 leftward as viewed in FIG. 1. The thread 62 has a slot or key-way 70 formed thereon that is engaged with an anti-rotation key 72 secured in the housing 48. This structure ensures that the mandrel 64 will move linearly within the tube 28 during the advancing and retracting of the mandrel 64.

The piston 58 has an end surface 74 that abuts an end surface 76 of the tube 28. The abutment between the end surfaces 74 and 76 is external to the die cavity 24. The mandrel has an end section 78 with a groove 80 formed therein and a seal 82 is secured in the groove 80. The seal 82 inhibits hydraulic fluid flow from a chamber 84 formed by the projection 32, the mandrel end section 78 and the inner surface 38 of the tube 28. The only portion of the interior of the tube 28 that can be pressurized is the portion between the projection 32 and the end section 78. Thus the high friction forces normally associated with hydroforming is limited to this portion and the remainder of the tube 28 is substantially free to slide along the inner surface of the die cavity 24 which is an improvement over the existing hydroforming apparatus and methods where multiple nodes are formed on a tube.

During the hydroforming operation, the tube 28 is inserted in the die 12 and the upper die 16 and the lower die 18 are closed. The end caps 20 and 22 are installed with the tube sealingly engaging the seal 36 and abutting the end cap 20. The mandrel is inserted into the tube 28 to the position 86 adjacent the recess 26. The chamber 84 is pressurized simultaneously with the pressurization of the piston 58. The hydraulic fluid in the chamber 84 urges the tube radially outward into the recess 26 and the piston 58 urged the tube 28 linearly into the die cavity such that the tube wall is not thinned during the hydroforming process. When the node 30 is fully formed, the pressure in the cavity 84 is released and the pressure at the piston 58 is reduced to a value sufficient to maintain contact between the ends 74 and 76. After the pressure is reduced, the mandrel is retracted by the servo motor 52 from the position 86 to a position 86A adjacent the recess 26A. The pressurization process is repeated until a node is formed in the cavity 26A. It will be appreciated by those skilled in the art that the portion of the tube adjacent the mandrel 64 outboard of the seal 82 is not pressurized and therefore not subjected to high normal forced during the hydroforming process. Thus the piston 58 does not need to overcome high friction forces between the tube 28 and the walls of the cavity 24 during axial feeding of the tube 28. The pressure control and movement of the mandrel is repeated until the final position 86N is reached and the recess 26N is filled with a tube node. The die is then opened and the tube 28 is removed and a new unformed tube is inserted.

Another important feature of the present invention is that the tube end 76 is external to the die cavity 24. This permits the tube 28 to be longer than the die cavity by at least the amount of tube to be axially fed into the cavity to prevent wall thinning during the hydroforming operation.

Figure 2:
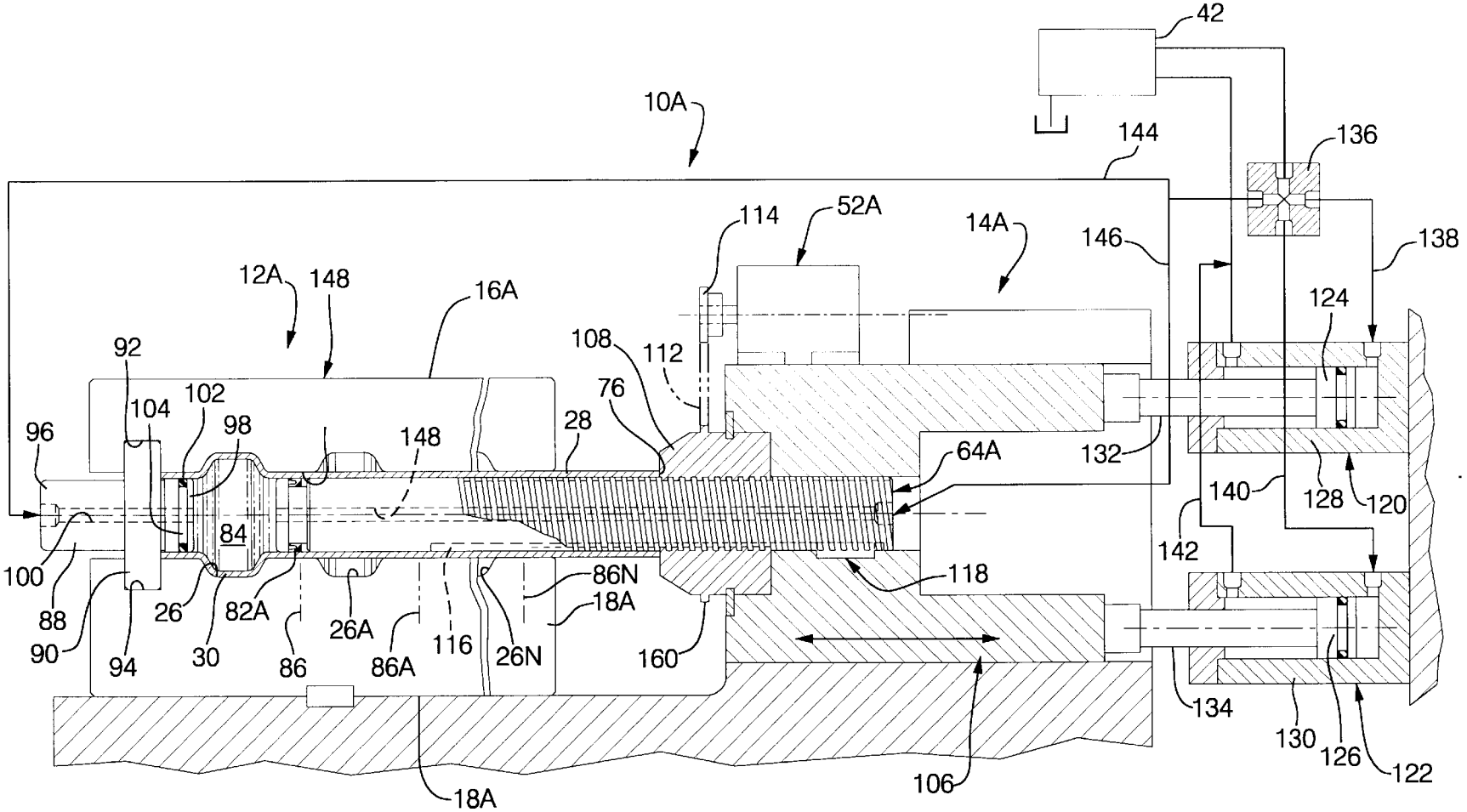
FIG. 2 is a sectional elevational view of a portion of a tube expansion mechanism incorporating another embodiment the present invention.

A hydroforming mechanism 10A, shown in FIG. 2, includes a die assembly 12A and a feed assembly 14A. the die assembly 12A has an upper die block 16A and a lower die block 18A that are urged together to close the die assembly 12A by a press, not shown. An end piece 88 has a collar 90 that is secured in recesses 92, 94 formed in the upper die 16A and the lower die 18A respectively when the die assembly 12A is closed. The end piece 88 has two projections 96, 98 that extend in opposite directions from the collar 90. The end piece 88 has a hydraulic passage 100 formed therethrough to permit communication of hydraulic fluid from the pump and control valving 42 to the cavity 24 of the die assembly 12A. A seal 102 secured in a groove 104 formed in the projection 98 inhibits leakage of hydraulic fluid from the cavity 24 when the passage 100 is pressurized.

The feed mechanism 14A includes a linearly moveable base 106 on which a block or pusher member 108 is rotatably mounted. The block 108 has a sprocket 110 formed thereon that meshes with a chain 112 that is also in mesh with a sprocket 114 secured for rotation with a servo or stepper motor 52A. A mandrel 64A is threadably engaged with the block 108 such that, when the block 108 is rotated, the mandrel 64A will be moved linearly. The linear translation of the mandrel 64A is ensured by a slot 116 and anti-rotation key 118. The feed mechanism 14A also has a pair of hydraulic actuators 120, 122. The actuators 120, 122 have respective pistons 124, 126 slidably mounted in cylinders 128, 130. The pistons 124, 126 have respective rods 132, 134 that engage the moveable base 106 to establish the linear position thereof relative to the die assembly 10A. The cylinders 128, 130 are hydraulically connected with a flow control block 136 through passages 138, 140 respectively. The cylinders 128, 130 are also connected directly with the pump and control valving 42 directly through passage 142. When the passages 138 and 140 are pressurized, the feed assembly 14A is urge toward the die assembly 14A and, when the passage 142 is pressurized, the feed assembly is urged away from the die assembly 14A. The control block 136 also distributes hydraulic fluid to passages 144 and 146 that are connected respectively with the passage 100 and a passage 148 that is formed in the mandrel 64A. The passage 148 communicates with the cavity 24 of the die assembly 12A. Either of the passages 100 or 148 can be eliminated as only one feed passage is required to pressurize the cavity 24 when hydroforming of the expansion nodes 30 is undertaken.

During the hydroforming process, the tube 28 is fitted onto the projection 98 in the open die assembly 12A. The mandrel 64A may be inserted into the tube 28 and the block 108 may engage the end 76 either before or after the projection 98 is engaged. The die assembly is closed and the servo motor is operated to ensure that the mandrel is at the position 86. The cavity 24 and cylinders 120, 122 are simultaneously pressurized. The pressure in the cavity 24 causes the hydroforming of the node 30 and the pressure on the pistons 124, 126 cause the tube to be moved axially into the cavity 24 during the hydroforming to prevent wall thinning of the tube 28. It should be appreciated that the mandrel 64A and the tube 28 move in unison during the hydroforming operation thereby reducing drag on the seal 82A. When the node 30 is fully formed, the pressure is reduced and the servo motor 52A is operated to move the mandrel 64A to the position 86A. During the repositioning of the mandrel 64A, the pressure is the cylinders 120 and 122 is maintained at a level to keep the block 108 in engagement with the end 76 of the tube 28. The hydroforming cycle and mandrel movement cycle continue until the final extension node is formed at the recess 26N.

As described above for the operation of the hydroforming machine 10, the frictional forces between the tube 28 and the die cavity are maintained at a minimum during the tube feeding when the chamber 84 is pressurized to form the nodes 30. Also as with the hydroforming machine 10A, the end 76 of the tube 28 extends outboard of the die cavity 24 thereby permitting the tube 28 to be longer than the die assembly 12A. The feed assembly 14A provides an additional benefit over the feed assembly 14. The feed assembly 14A moves the mandrel 64A and the block 108 linearly in unison during the hydroforming cycle thereby reducing the drag between the seal 82A and the inner surface of the tube 28.

Figure 3:
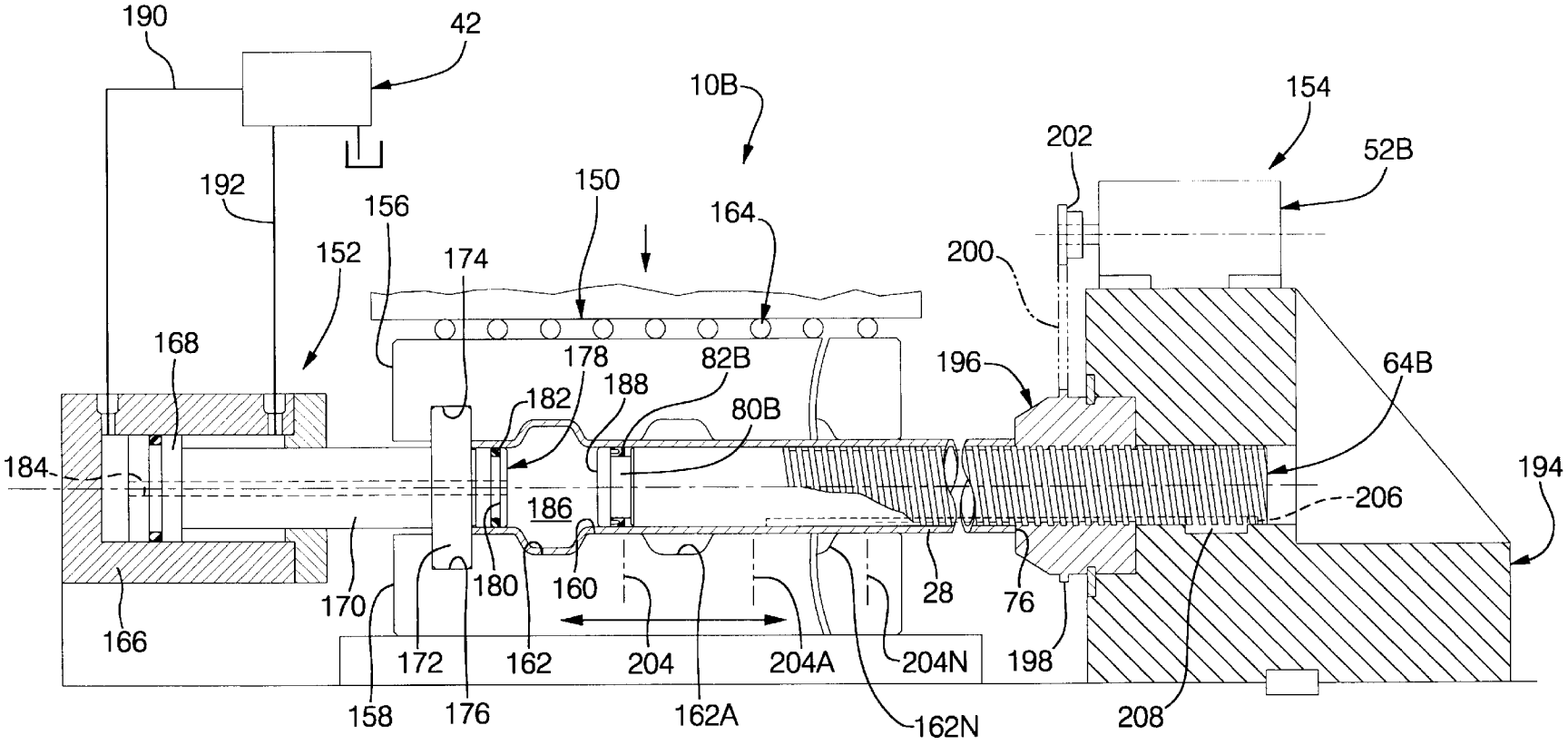
FIG. 3 is a sectional elevational view of a portion of a tube expansion mechanism incorporating yet another embodiment the present invention.

The hydroforming machine 10B, shown in FIG. 3, includes a die assembly 150, a feed mechanism 152 and a position control mechanism 154. The die assembly 150 has an upper die 156 and a lower die 158 that cooperate when the die assembly 150 is closed to from a cavity 160 in which a plurality of recesses 162 are formed. The die assembly 150 is closed by a press, not shown. A plurality of rollers or anti-friction surface 164 are positioned between the upper die 156 and the press, and the lower die 158 is mounted on an antifriction surface or rollers. This permits the die assembly 150 to move linearly during the hydroforming process.

The feed mechanism 152 includes a stationary cylinder 166 and a linearly moveable piston 168. A rod 170 extends from the piston 168 into the cavity 160. The rod 170 has a collar 172 that engages in recesses 174, 176 formed in the upper die 156 and lower die 158 respectively. The rod 170 terminates in a projection 178 that has a groove 180 formed therein to support a seal 182. A passage 184 extends longitudinally through the rod 170 to permit fluid communication between the cylinder 166 and to a chamber 186 formed in the cavity 160 between the projection 178 and an end 188 of a mandrel 64B. A seal 82B is positioned in a groove 80B to assist in sealing the chamber 186. The cylinder is in fluid communication with the pump and control valving 42 through passages 190 and 192. Fluid pressure in the passage 190 will urge the piston 168 and the die assembly 150 rightward as viewed in FIG. 3. Fluid pressure in the passage 192 will urge the piston 168 and die assembly 150 leftward.

The positioning mechanism 154 includes a mounting block 194 on which is rotatably mounted a block or pusher member 196 that threadably engages the mandrel 64B. The block 196 includes a sprocket 198 that is engaged by a chain 200 that also engages a sprocket 202 secured for rotation with the servo or stepper motor 52B. The block 196 is disposed in abutment with the end 76 of the tube 28 during the hydroforming process.

During the hydroforming process, the tube 28 is slidably supported on the projection 178 and the mandrel 64B. The piston 168 is fully retracted to the leftmost position as is the die assembly. The block 196 in abutment with the end 76 of the tube 28. The mandrel is advanced to the position 204 and the piston 168 and cavity 186 are pressurized. The pressure in the cavity 186 forces the tube 28 radially outward into the recess 162 and the piston pushes the die assembly 150 rightward to effectively feed the tube 28 linearly to fill the recess 162 with out wall thinning of the tube 28. When the node 30 is fully formed on the tube 28, the pressure is reduced to a level to maintain contact between the tub end 76 and the block 196. The mandrel is then retracted from the position 204 to the position 204A by operation of the servo motor 52B. The cylinder 166 and cavity 186 are again pressurized by the pump and control valving 42 to form a node on the tube 28 at the recess 162A. The hydroforming and positioning cycles are repeated until the final node is formed at the recess 162N. A slot 206 and anti-rotation key 208 prevent relative rotation between the mandrel 64B and the tube 28 during repositioning of the mandrel 64B between hydroforming cycles. As with the previously described embodiments, the forming machine 10B permits the tube 28 to be longer than the die assembly 150, and the friction between the tube 28 and the cavity 160 is reduced to a minimum. Also as described above in the embodiment 10A, the embodiment 10B does not permit relative movement between the seal 82B and the interior of the tube 28 during the hydroforming cycle. Since the relative motion between the seal 82B and the tube 28 is limited to linear motion only, the wear effect on the seal 82B is reduced.

Figure 4:
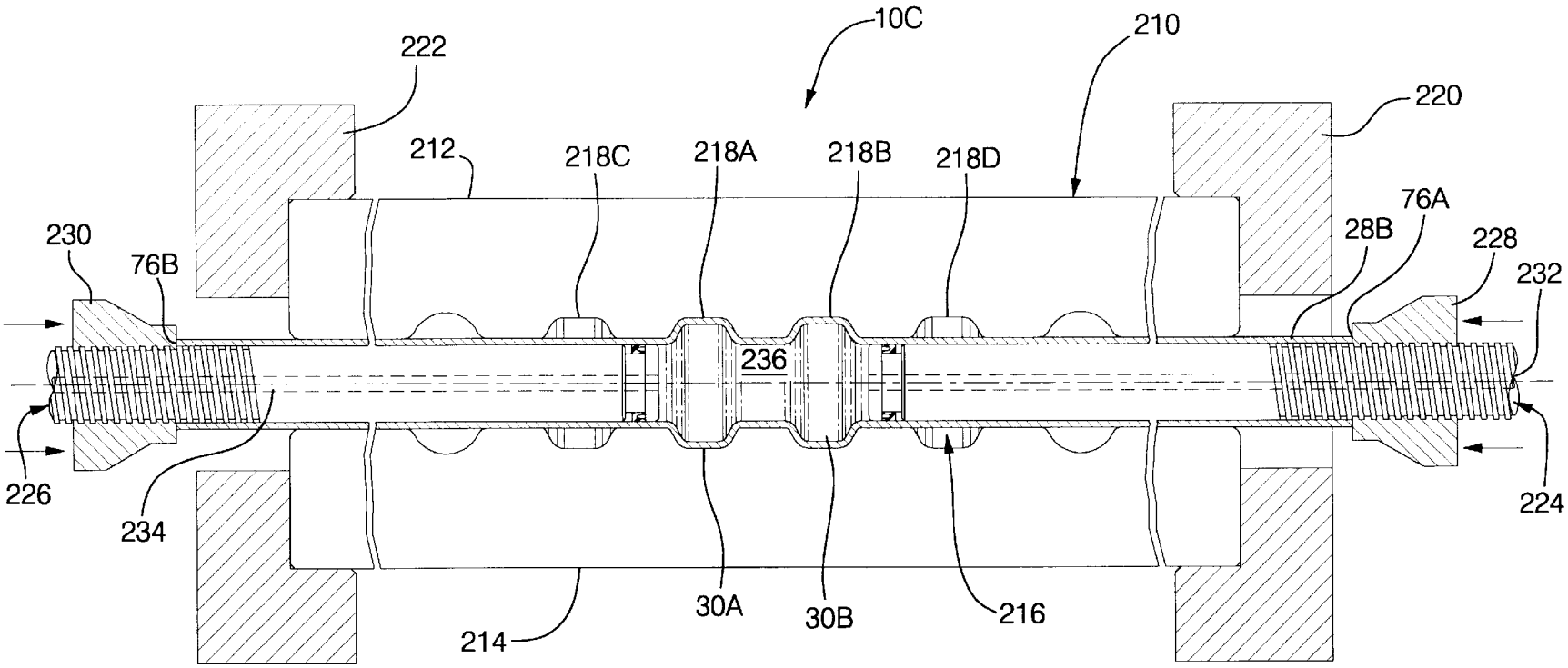
FIG. 4 is a sectional elevational view of a portion of a tube expansion mechanism incorporating a furter embodiment the present invention.

A portion of a hydroforming machine 10C is shown in FIG. 4. This machine 10C undertakes the simultaneous forming of pairs of nodes 30A, 30B on the tube 28B. the forming machine 10C has a die assembly 210 having an upper die 212 and a lower die 214. The upper die 212 and lower die 214 are forced into abutment by a conventional press, not shown, to form a cavity 216 that includes a plurality of recesses or nodules 218. The ends of the upper and lower dies 212, 214 are also contained by end caps 220, 222.

A pair of mandrels 224 and 226 extend into the cavity 216 from opposite direction. The position control and linear movement of the mandrels 224, 226 can be accomplished by any of the feed mechanisms shown in FIGS. 1, 2 or 3 or similar devices. Each mandrel 224 and 226 passes through or is threadably engaged with blocks or pusher members 228 and 230 respectively. Each mandrel 224 and 226 has a central longitudinal passage 232 and 234 respectively through which pressurized hydraulic fluid is admitted to a chamber 236 during the hydroforming cycle. The chamber 236 is formed by the mandrels 224, 226 and the interior of the tube 28B. if desired one of the passages 232 or 234 can be eliminated.

The blocks 228 and 230 are held in abutment with respective ends 76A and 76B by mechanism such as those shown in FIGS. 1,2 or 3. The blocks 228 and 230 can be moved in linearly unison with the respective mandrels 224 and 226 during hydroforming as described with FIG. 2 or in independently as described with FIG. 1. The important feature shown in FIG. 4 is that two nodes are formed substantially simultaneously on the tube 28*b* and both ends 76A and 76B of the tube 28A are urged into the die cavity 216 during the hydroforming cycle. The mandrels 224 and 226 are preferably withdrawn to new forming positions adjacent the nodules 218D and 218C respectively when the pressure within the chamber 236 is reduced. The chamber 236 is again pressurized during the hydroforming cycle to form nodes on the tube 28B at the nodules 218D and 218C. The positioning cycle and the hydroforming cycle and repeated until all of the nodes have been formed on the tube 28B. As is evident in FIG. 4, the ends 76A and 76B are positioned externally of the cavity 216 of the die assembly 210.

The tubes 28, 28B can be of any cross-section provided the cross-section is the constant between the positions at which the nodes are to be formed.

What is claimed is:

1. An apparatus for hydroforming nodes on a tubular member comprising:

die means having a cavity with a plurality of spaced nodules;

a tube member disposed in the cavity having first and second end portions and a first of said end portions extending outboard of the cavity;

pressure sealing means disposed in said tube member and cooperating with said tube member to form a chamber, said pressure sealing means including a mandrel;

means for pressurizing said chamber, including a passage through a portion of said pressure sealing means, for urging said tube into one of said nodules during a hydroforming cycle;

feed means abutting one of said end portions for urging said tube member into said cavity during said pressurizing of said chamber;

positioning means for moving said mandrel sequentially within said tube to position adjacent sequential nodules in said cavity when a pressure in said chamber is reduced by said pressurizing means during a positioning cycle.

2. The apparatus for hydroforming nodes on a tubular member defined in claim 1 further comprising:

said feed means comprising a pusher member disposed circumjacent a portion of said mandrel in abutment with said first end portion;

said positioning means comprising a threaded connection and a key and slot structure for moving said mandrel linearly within said tube member to said sequential modules.

3. The apparatus for hydroforming nodes on a tubular member defined in claim 2 further comprising:

said pusher member being moveable longitudinally along said mandrel when said chamber is being pressurized.

4. The apparatus for hydroforming nodes on a tubular member defined in claim 2 further comprising:

said feed mechanism and said positioning mechanism being interconnected by said threaded connection including a threaded portion on pusher member and a threaded portion on said mandrel, said pusher member and said mandrel moving linearly within said tube member during the hydroforming cycle when said chamber is pressurized, said mandrel being moveable linearly relative to said pusher member during the positioning cycle when the pressure in said chamber is reduced.

5. The apparatus for hydroforming nodes on a tubular member defined in claim 1 further comprising:

said feed means being disposed adjacent said second end portion of said tube within said cavity and said mandrel extending outboard of said cavity through said first end portion of said tube.

6. The apparatus for hydroforming nodes on a tubular member defined in claim 1 further comprising:

said second end portion extending outboard of said cavity in a direction opposite said first end portion;

said pressure sealing means comprising a second mandrel extending outboard of said die cavity through said second end portion;

said feed means abutting the other of said end portions also for urging said tube member into said cavity from both ends during the hydroforming cycle; and said positioning means moving said mandrels in opposite directions to positions adjacent sequential nodules in the direction of mandrel motion during the positioning cycle.

7. A method of hydroforming a plurality of nodes on a tubular member comprising the steps of:

positioning a tube member in a die having a plurality of nodules;

sealing a first portion of the tube with a moveable mandrel;

sealing a second portion of the tube to form a chamber between the first and second portions;

positioning the mandrel adjacent a first of the nodules;

performing a hydroforming cycle by pressurizing the chamber to form a node on said tube by urging a portion of the tube outward into the first nodule and simultaneously feeding the tube linearly into the die cavity;

performing a positioning cycle by reducing the pressure in the chamber and moving the mandrel linearly to a position adjacent the next sequential nodule; and repeating the hydroforming cycle and the positioning cycle until the plurality of nodes have been formed.

* * * * *